US011186102B2

(12) United States Patent
Yada et al.

(10) Patent No.: US 11,186,102 B2
(45) Date of Patent: Nov. 30, 2021

(54) PRINTER AND ELECTRONIC APPARATUS

(71) Applicant: FUJITSU COMPONENT LIMITED, Tokyo (JP)

(72) Inventors: Yuji Yada, Tokyo (JP); Tetsuhiro Ishikawa, Tokyo (JP); Masahiro Tsuchiya, Tokyo (JP); Hiromi Ohtsuka, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/737,042

(22) Filed: Jan. 8, 2020

(65) Prior Publication Data

US 2020/0247151 A1 Aug. 6, 2020

(30) Foreign Application Priority Data

Jan. 31, 2019 (JP) ..... JP2019-015791

(51) Int. Cl.

| | |
|---|---|
| ***B41J 11/70*** | (2006.01) |
| ***B41J 15/04*** | (2006.01) |
| ***B41J 11/04*** | (2006.01) |
| ***B26D 1/34*** | (2006.01) |

(52) U.S. Cl.

CPC ..... *B41J 11/70* (2013.01); *B26D 1/345* (2013.01); *B41J 11/04* (2013.01); *B41J 15/042* (2013.01)

(58) Field of Classification Search

CPC ..... B26D 1/345

See application file for complete search history.

(56) References Cited

U.S. PATENT DOCUMENTS

| | | | | |
|---|---|---|---|---|
| 5,223,940 | A * | 6/1993 | Matsumoto | B26D 1/385 346/104 |
| 9,688,085 | B2 | 6/2017 | Yada et al. | |
| 9,724,947 | B2 | 8/2017 | Yada et al. | |
| 2004/0037606 | A1* | 2/2004 | Tsuchiya | B41J 11/70 400/621 |
| 2008/0151030 | A9* | 6/2008 | Silverbrook | G06K 7/1417 347/104 |
| 2010/0247221 | A1* | 9/2010 | Tsugaru | B41J 11/70 400/621 |
| 2015/0251459 | A1* | 9/2015 | Murata | B41J 15/042 347/220 |

FOREIGN PATENT DOCUMENTS

| | | |
|---|---|---|
| JP | 2017-052213 | 3/2017 |
| JP | 2017-056708 | 3/2017 |

* cited by examiner

*Primary Examiner* — Jennifer Bahls

(74) *Attorney, Agent, or Firm* — IPUSA, PLLC

(57) ABSTRACT

A printer includes a print head that prints on recording sheet, a platen roller that transports the recording sheet pinched between the print head and the platen roller, a movable blade that cuts the recording sheet, a roller driving module that drives the platen roller, and a cutter driving module that drives the movable blade. The roller driving module and the cutter driving module are both provided at one end along an axial direction of the platen roller.

10 Claims, 16 Drawing Sheets

PRINTER AND ELECTRONIC APPARATUS

CROSS-REFERENCE TO RELATED APPLICATION

This application is based upon and claims priority to Japanese Patent Application No. 2019-015791, filed on Jan. 31, 2019, the entire contents of which are incorporated herein by reference.

FIELD

Certain aspects of the embodiments discussed herein are related to a printer, and an electronic apparatus.

BACKGROUND

Printers configured to issue receipts or the like are applied to various use, such as in a cash register, an Automated Teller Machine (ATM), or the like.

There are printers having a housing with a rotatable lid, and recording paper can be set by opening the lid.

Examples of the printers include printers described in Japanese Laid-Open Patent Publication No. 2017-52213, and Japanese Laid-Open Patent Publication No. 2017-56708, for example.

The printer may include a roller driving module on one end of a thermal head, and a cutter driving module on the other end of the thermal head. The roller driving module includes a motor and a gear, which rotate a platen roller for transporting the recording paper. The cutter driving module includes a motor and a gear, which drive a movable blade. In such a printer, a direction in which the recording paper may be inserted into the printer is restricted, due to the driving modules that interfere with the recording paper insertion.

SUMMARY

According to one aspect of the embodiments, a printer includes a print head configured to print on recording sheet; a platen roller configured to transport the recording sheet pinched between the print head and the platen roller; a movable blade configured to cut the recording sheet; a roller driving module configured to drive the platen roller; and a cutter driving module configured to drive the movable blade, wherein the roller driving module and the cutter driving module are both provided at one end along an axial direction of the platen roller.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

DESCRIPTION OF EMBODIMENTS

Figure 1:
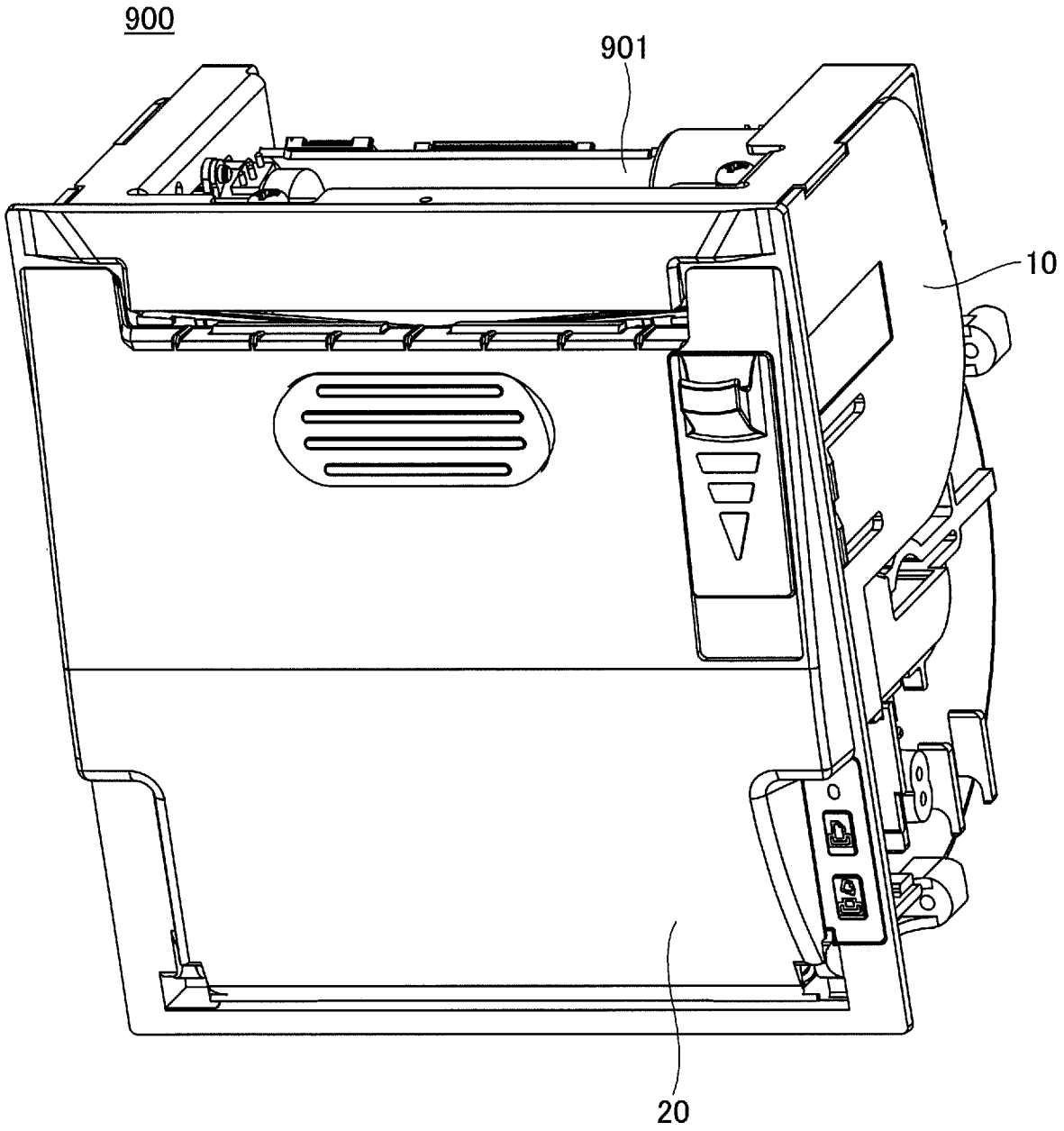
FIG. 1 is a perspective view of a printer unit.

Preferred embodiments of the present invention will be described with reference to the accompanying drawings. In the drawings, those parts that are the same are designated by the same reference numerals, and a repeated description of the same parts may be omitted.

Figure 2:
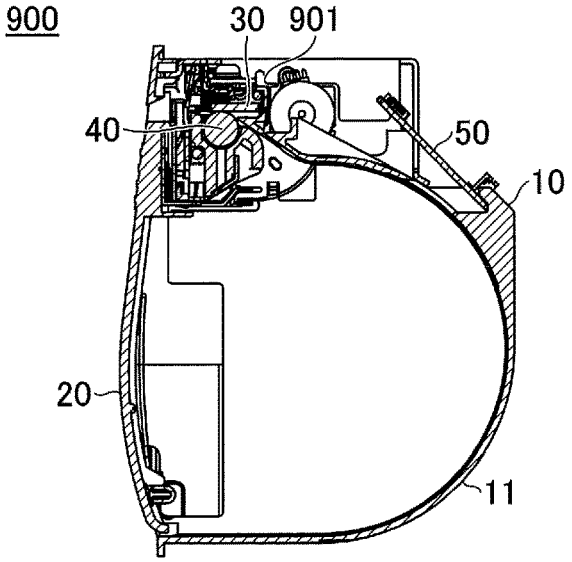
FIG. 2 is a cross sectional view of the printer unit in a state where a lid is closed.
Figure 3:
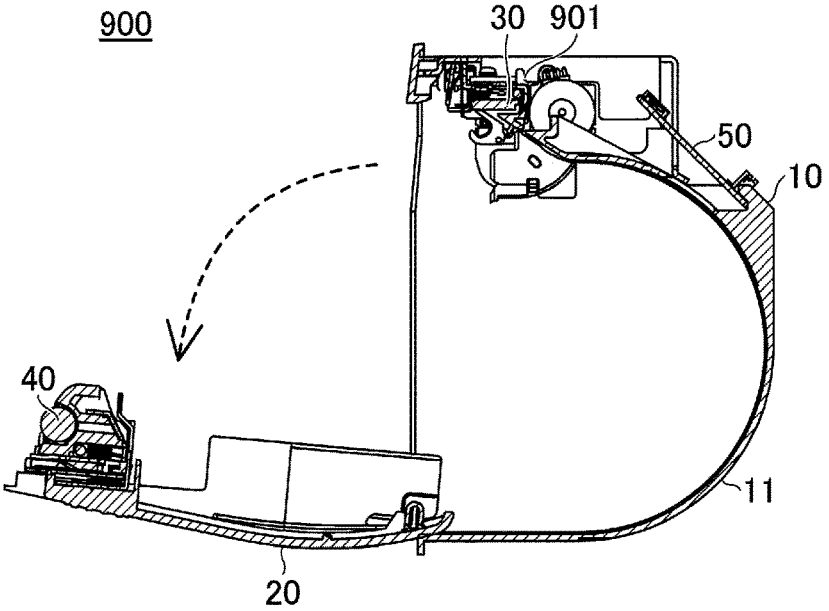
FIG. 3 is a cross sectional view of the printer unit in a state where the lid is open.

FIG. 1 is a perspective view of a printer unit, and FIG. 2 and FIG. 3 are cross sectional views of the printer unit in a state where a lid is closed and a state where the lid is open, respectively. In the following, the printer unit which uses a roll of recording paper as recording sheet will be described.

The printer unit illustrated in FIGS. 1 through 3 includes a housing 10, a lid 20, a printer 901, and a board 50. The lid 20 is rotatably mounted on the housing 10.

A holder 11, which receives the recording paper, is provided on the housing 10. The holder 11 is mounted with the board 50, and constituent elements of the printer 901, such as a print head 30, a fixed blade, and motors. The holder 11 is integrally formed on the housing 10. Circuits and devices that control the printer 901 are mounted on the board 50. A recording paper transport motor, and a movable blade driving motor are mounted in the printer unit 900. A platen roller 40, and a movable blade are mounted on the lid 20.

The recording paper inside the holder 11 is transported by the platen roller 40, in a state pinched between the print head 30 and the platen roller 40, and the print head 30 prints on the recording paper.

Figure 4:
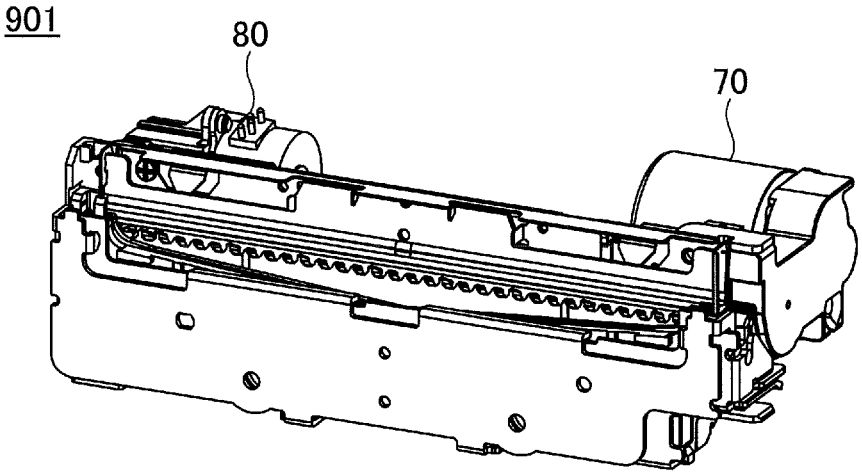
FIG. 4 is a perspective view of a printer.

As illustrated in FIG. 4, the fixed blade and the movable blade are provided in the printer 901, so that longitudinal directions of these blades coincide with an axial direction of the platen roller 40. A driving module 70 including a motor and a gear for driving the platen roller 40 is provided on one end of the platen roller 40. A driving module 80 including a motor and a gear for driving the movable blade is provided on the other end of the platen roller 40.

The platen roller 40 and the print head 30 are mounted, so that the axial direction of the platen roller 40 and a longitudinal direction of the print head 30 are parallel to each other. When the lid 20 is closed, the recording paper is pinched between the platen roller 40 and the print head 30, to enable printing on the recording paper. The recording paper is cut by the movable blade and the fixed blade.

As indicated by an arrow in FIG. 3, the lid 30 is opened in a direction perpendicular to the longitudinal direction of the print head 30, to insert the recording paper into the holder 11. In this case, a space is required in front of the printer 901 to enable opening of the lid 20. If an object is positioned near the lid 20, the lid 20 cannot be opened, and thus, the recording paper cannot be inserted into the holder 11.

In addition, although the recording paper is required to be pinched between the platen roller 40 and the print head 30, the driving modules 80 and 70 are arranged on respective sides of the print head 30. For this reason, the driving module 80 or the driving module 70 interferes with the recording paper insertion, and prevent the recording paper from being set from the side of the printer 901.

Figure 5:
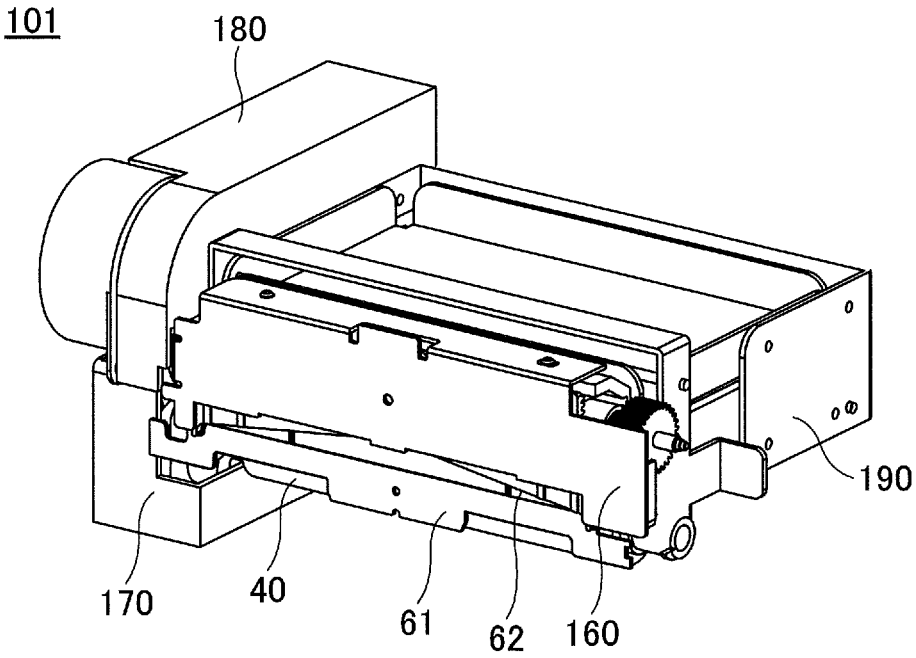
FIG. 5 is a perspective view of the printer according to one embodiment.
Figure 6:
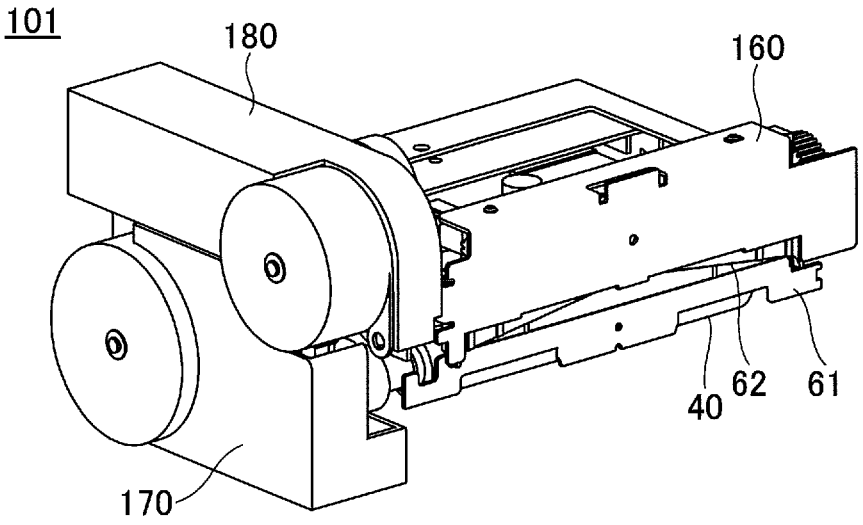
FIG. 6 is a perspective view of the printer.
Figure 7:
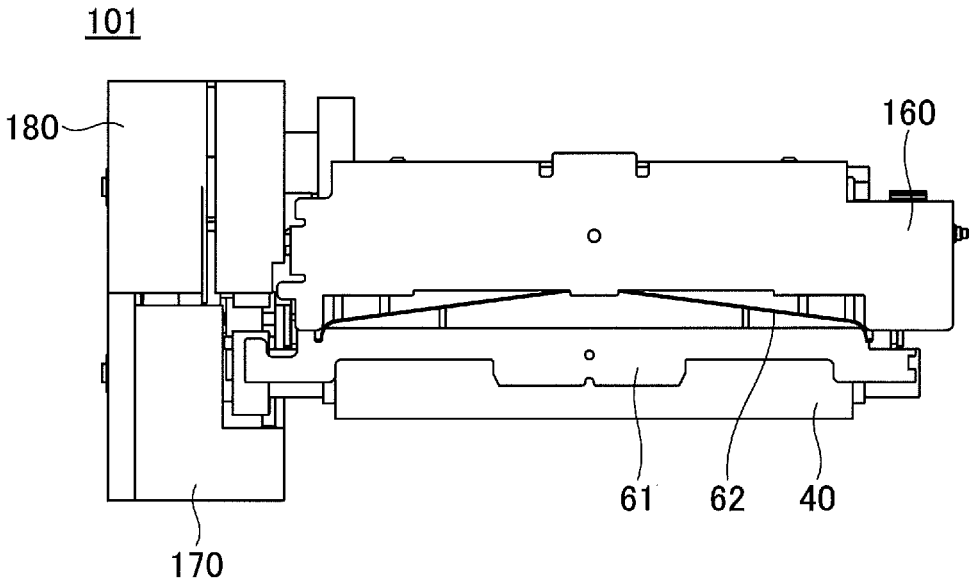
FIG. 7 is a front view of the printer.
Figure 8:
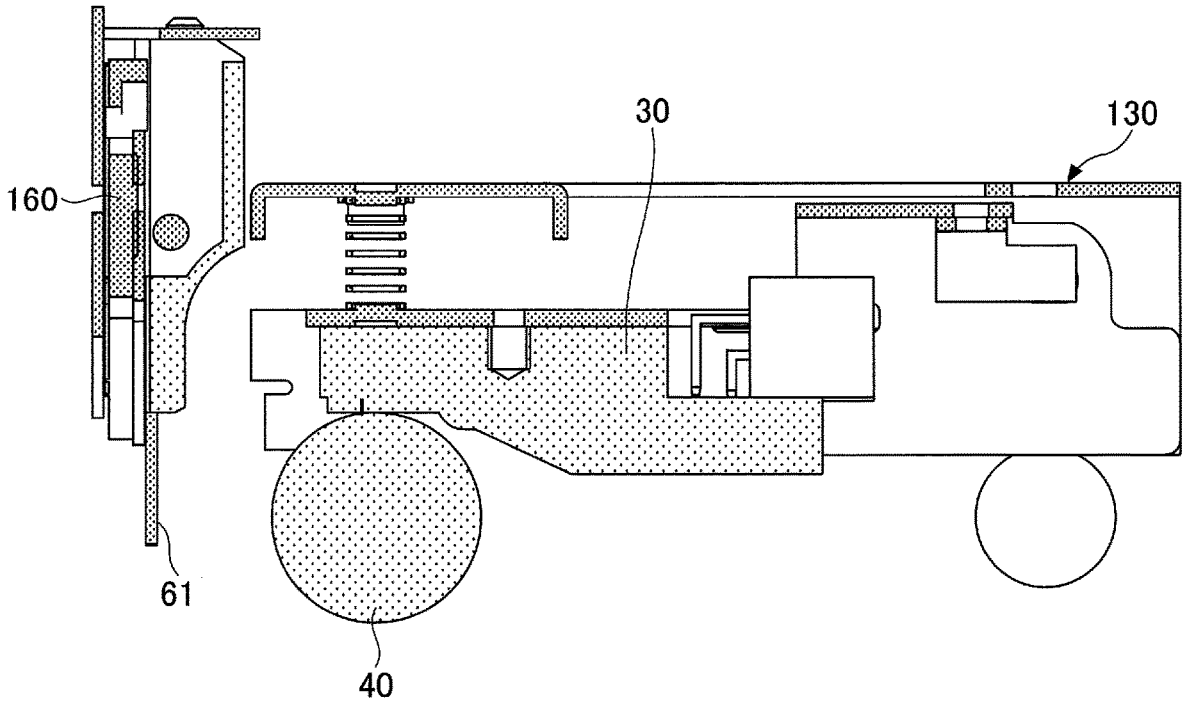
FIG. 8 is diagram for explaining the printer.

A printer according to one embodiment will be described, by referring to FIGS. 5 through 8. FIGS. 5 and 6 are perspective views of a part of the printer according to one embodiment. FIGS. 7 and 8 are a front view and a cross sectional view of the printer, respectively.

A printer 101 according to this embodiment includes the print head 30, the platen roller 40, a cutter module 160 having a fixed blade 61 and a movable blade 62, a driving module 170 that drives and rotates a roller, and a driving module 180 that drives the movable blade 62.

In the printer 101, the driving module 170 and the driving module 180 are both provided on one end of the platen roller 40, and no driving module is provided on the other end of the platen roller 40. For this reason, the recording paper can be inserted into the printer 101 from the side that is not provided with the driving modules 170 and 180. As illustrated in FIG. 6, the driving modules 170 and 180 are arranged to vertically overlap each other.

An example of a scale mounted with the printer 101 will be described.

Figure 9:
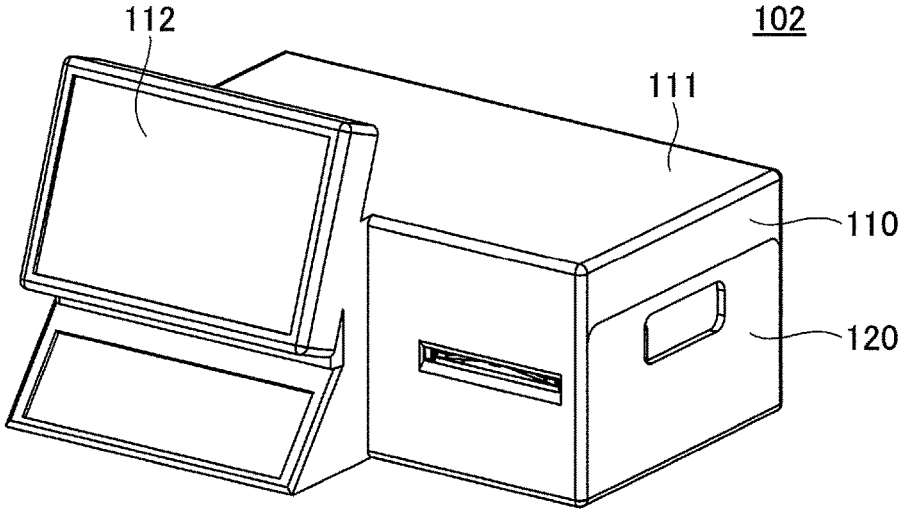
FIG. 9 is a diagram for explaining a scale according to one embodiment.
Figure 10:
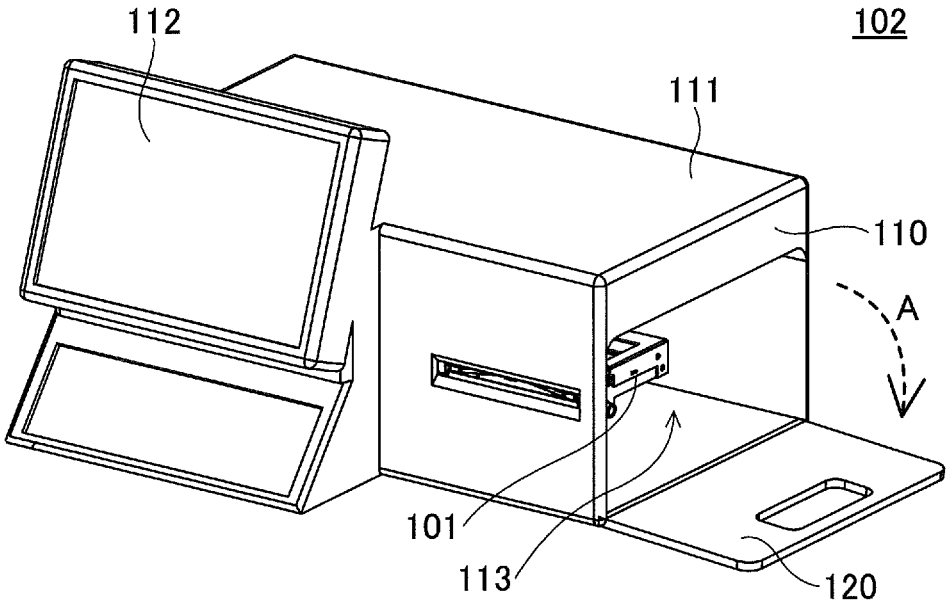
FIG. 10 is a diagram for explaining the scale.
Figure 11:
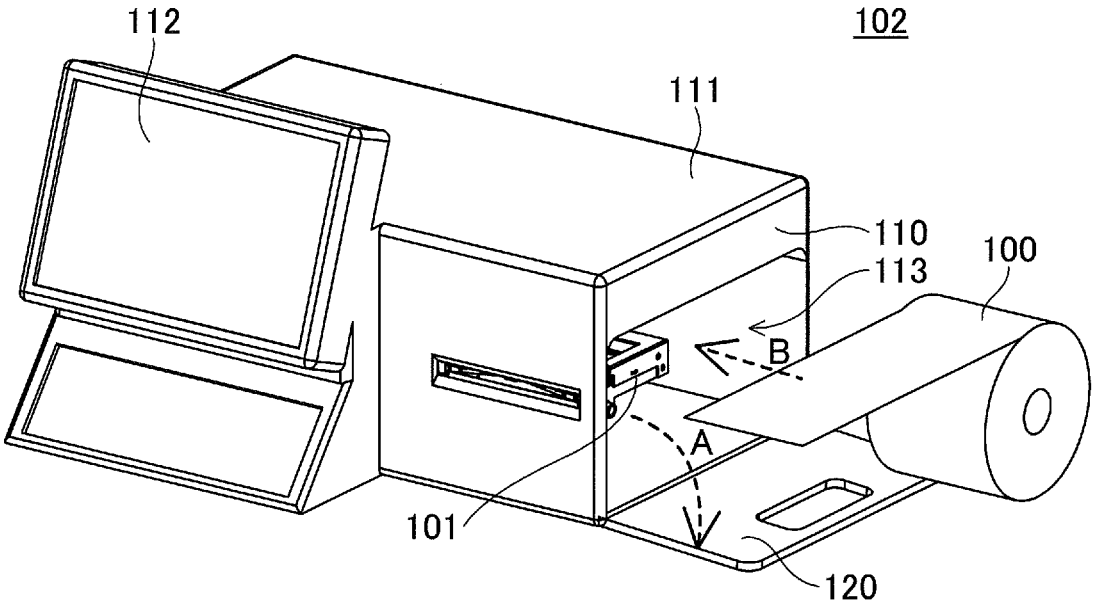
FIG. 11 is a diagram for explaining the scale.

A scale 102 illustrated in FIGS. 9 through 11 includes a measuring part 111 on which an item to be measured is placed, and the printer 101 is set inside a housing 110. A weight of the item placed on the measuring part 111 is displayed on a display 112, and the weight may be printed by the printer 101. Because the measuring part 111 is provided at an upper part of the scale 102, an upper part of the housing 110 cannot be opened, and an operation to set or replace the recording paper becomes difficult when the printer 901 illustrated in FIG. 4 is used.

Figure 12:
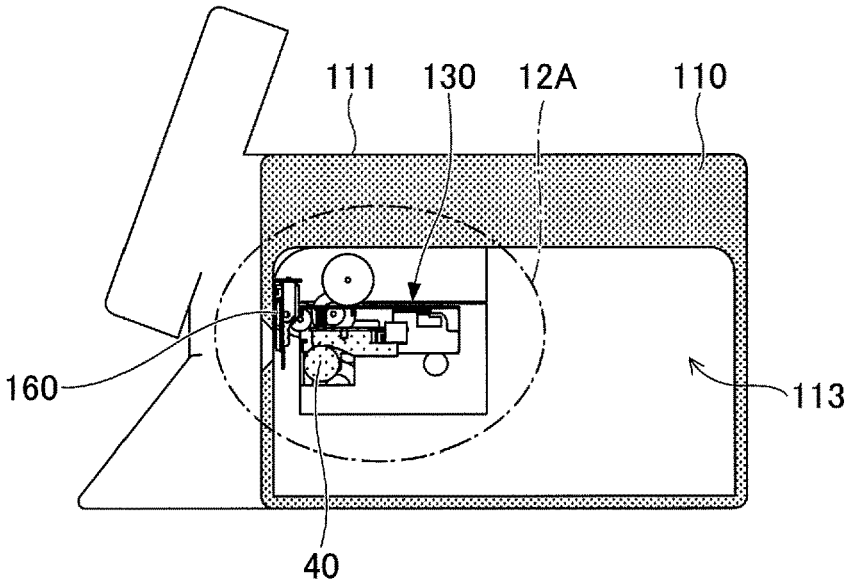
FIG. 12 is a diagram for explaining an inside of the scale.
Figure 13:
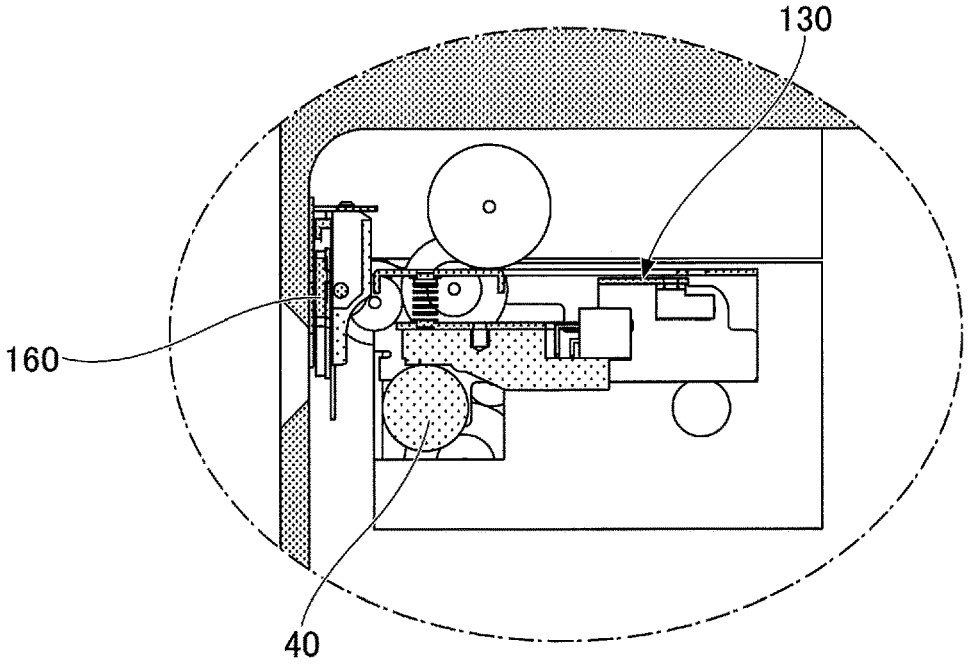
FIG. 13 is an enlarged view of a part of FIG. 12.
Figure 14:
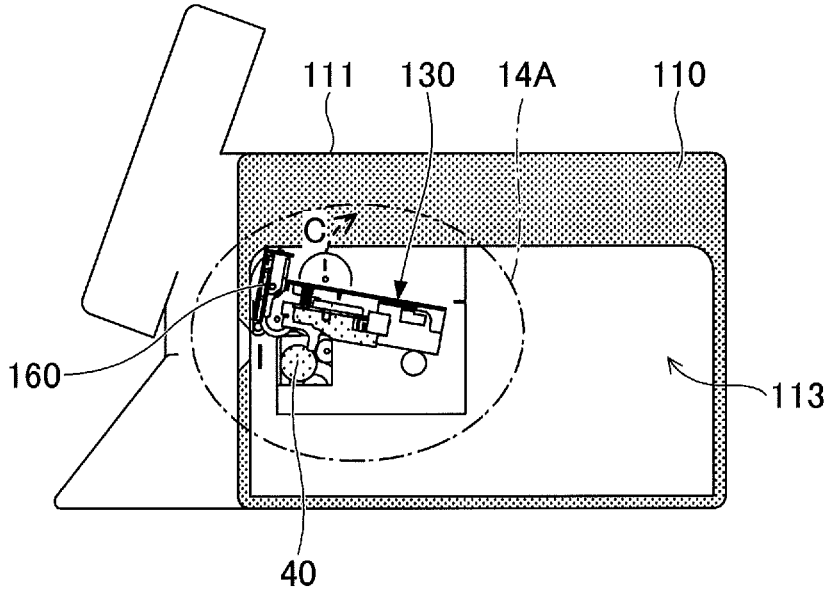
FIG. 14 is a diagram for explaining the inside of the scale.
Figure 15:
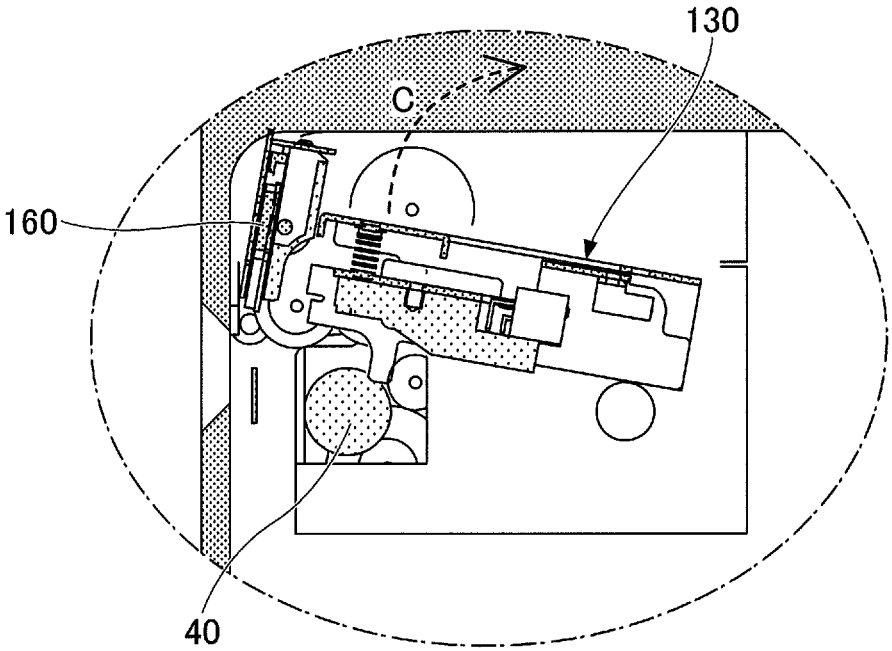
FIG. 15 is an enlarged view of a part of FIG. 14.

In this embodiment, the printer 101 is provided on the scale 102, so that the recording paper can be set or replaced from the side of the scale 102, and the upper part of the scale 102 does not need to open and close. When setting the recording paper into the scale 102, a lid 120 on the side of the housing 110 is opened in a direction A as illustrated in FIG. 10 and FIG. 11. Then, recording paper 100 is inserted into a holder 113 in a direction B in FIG. 11. When setting the recording paper, the head module 130 including the print head 30, and the cutter module 160 are lifted in a direction C as illustrated in FIG. 14 and FIG. 15, to separate the print head 30 and the platen roller 40 from each other, and to separate the movable blade 62 and the fixed blade 61 from each other. Because the driving modules 170 and 180 are not provided on the side of the printer 101 provided with the lid 120, the recording paper 100 can be inserted from the side of the printer 101, in between the print head 30 and the platen roller 40, in a state illustrated in FIG. 14. Thereafter, the head module 130 and the cutter module 160 are lowered, to pinch the recording paper 100 between the print head 30 and the platen roller 40, so that the recording paper 100 becomes printable by the print head 30. FIG. 13 is an enlarge view of a region 12A illustrated in FIG. 12, and FIG. 15 is an enlarged view of a region 14A illustrated in FIG. 14.

Figure 16:
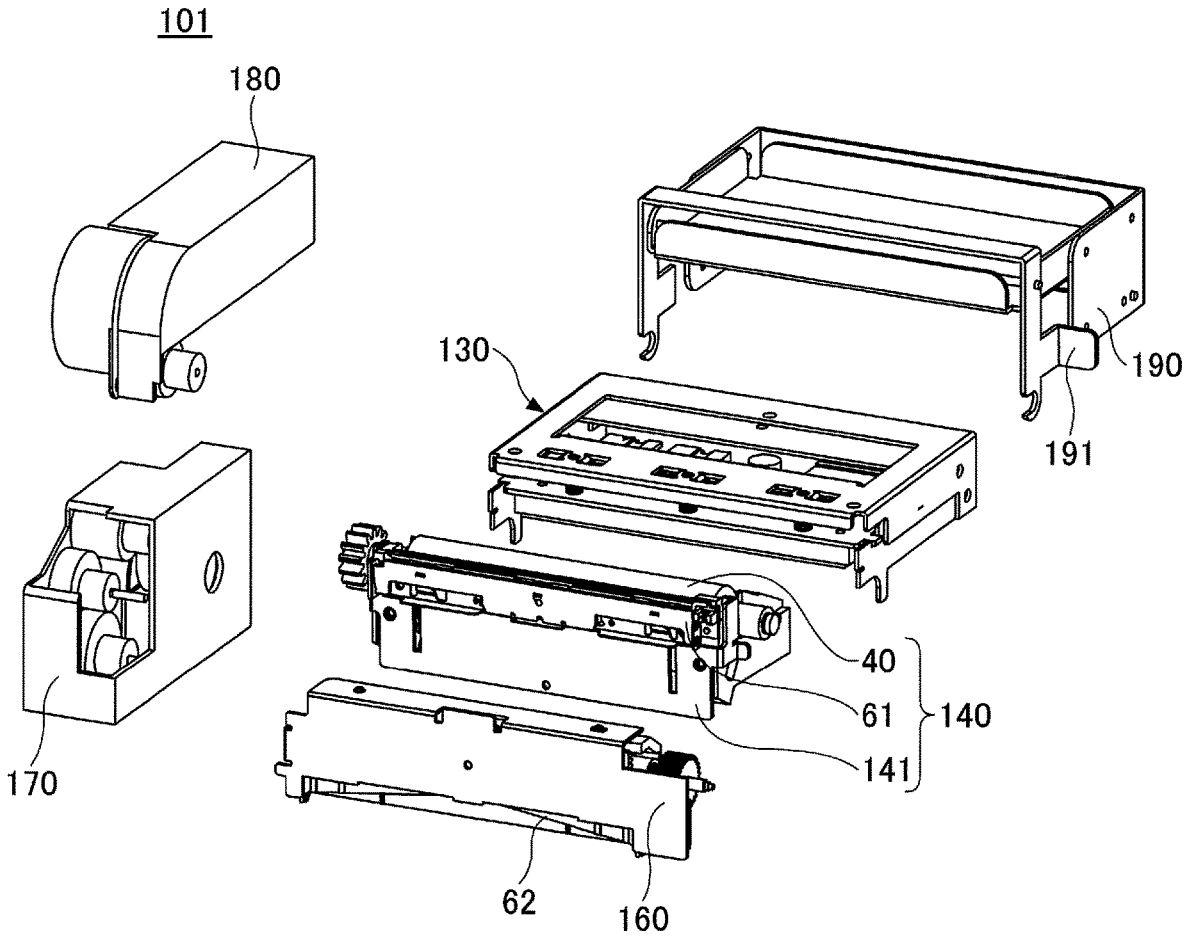
FIG. 16 is a disassembled perspective view of the printer.

The printer 101 is formed by modules that are separable for each function. In FIG. 16, the head module 130, the platen roller 40, the fixed blade 61, a cutter module 160, and the driving modules 170 and 180 are detachably mounted on a frame 190. A combination of the platen roller 40 and the fixed blade 61 may be referred to as a "platen module 140". The platen module 140 may be assembled by mounting the fixed blade 61 on a bracket 141, and fitting the platen roller 40 into a groove of the bracket 141. A lever 191 for separating the head module 130 and the platen module 140 from each other, is mounted on the frame 190. The head module 130 and the platen module 140 separate from each other when a bearing of the platen roller 40 disengages from a hook located on a lower end of the lever 191.

In this embodiment, the printer 101 is assembled by mounting the head module 130, the platen module 140, the cutter module 160, and the driving modules 170 and 180 on the frame 190. When repairing the printer 101, each module, that is, each of the head module 130, the platen module 140, the cutter module 160, and the driving modules 170 and 180 is selectively and separately replaceable.

Figure 17:
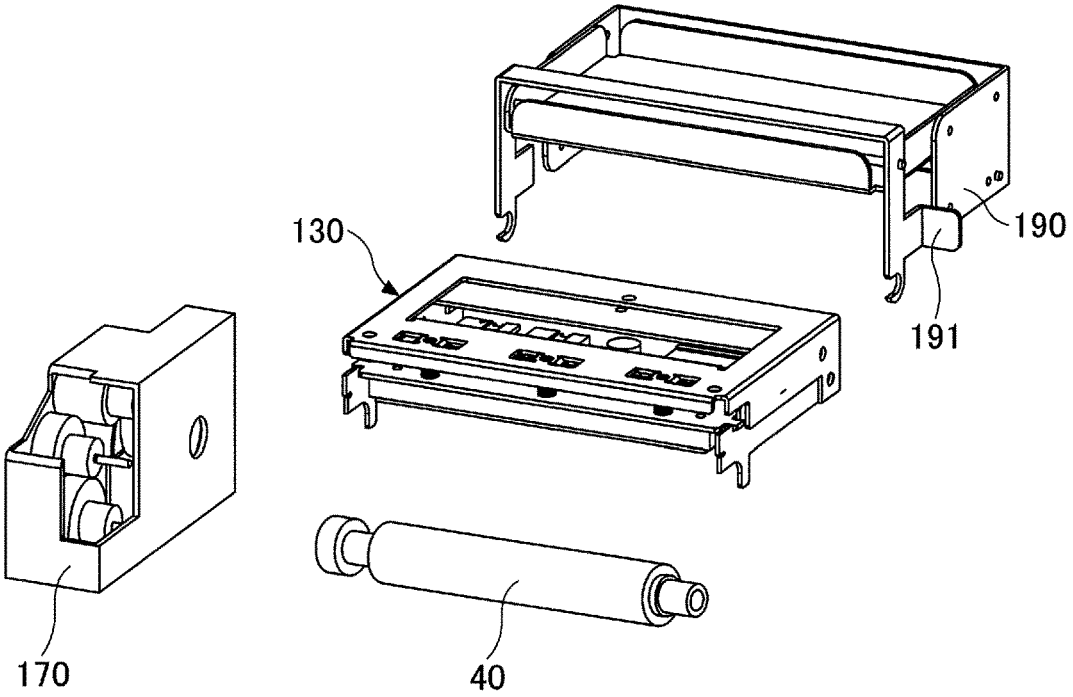
FIG. 17 is a disassembled perspective view of the printer according to a first modification.
Figure 18:
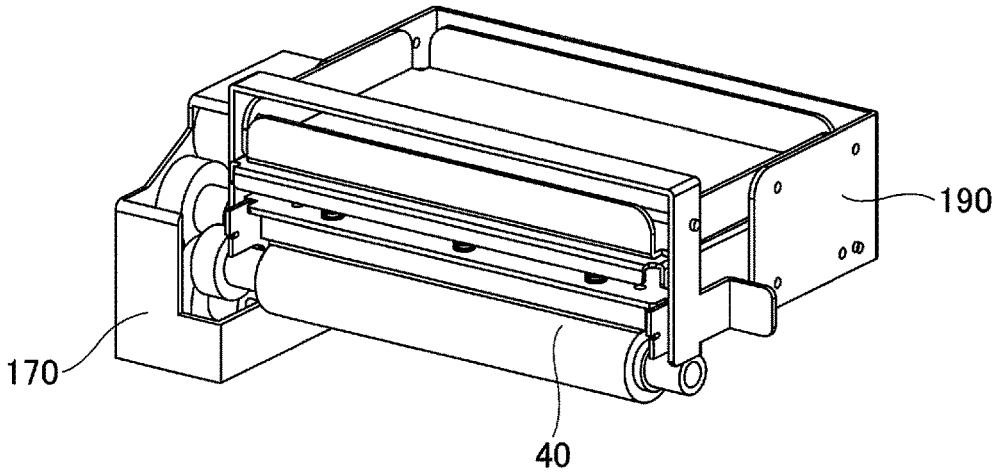
FIG. 18 is a perspective view of the printer according to the first modification.

The printer 101 illustrated in FIGS. 5 and 16 includes the cutter module 160. However, the cutter module 160 may be omitted as illustrated in FIGS. 17 and 18, by mounting the head module 130 and the driving module 170 on the frame 190.

Figure 19:
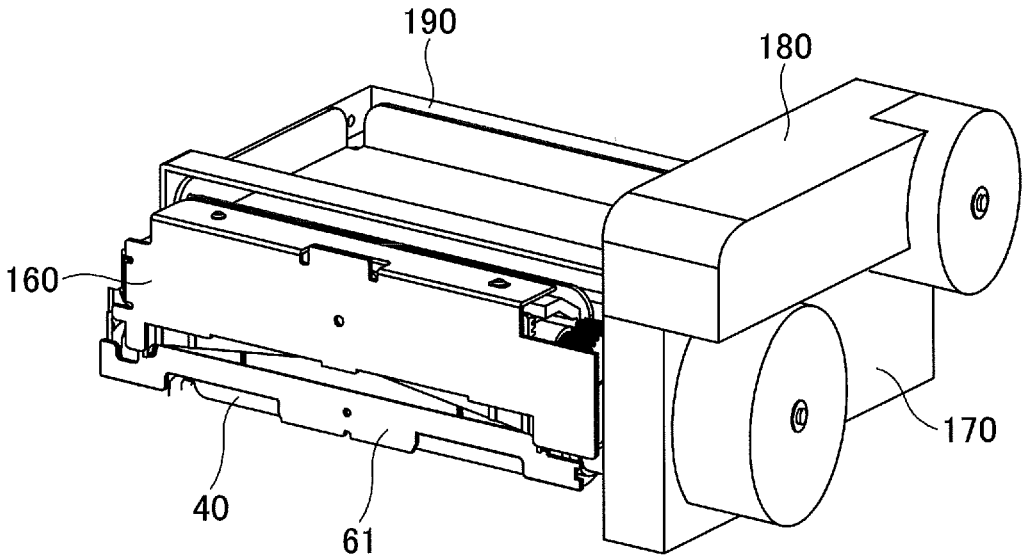
FIG. 19 is a perspective view of the printer according to a second modification.

As illustrated in FIG. 19, it is possible to mount the driving modules 170 and 180 on the side of the printer 101, opposite from the side provided with the driving modules 170 and 180 in the example illustrated in FIGS. 5 and 16.

Figure 20:
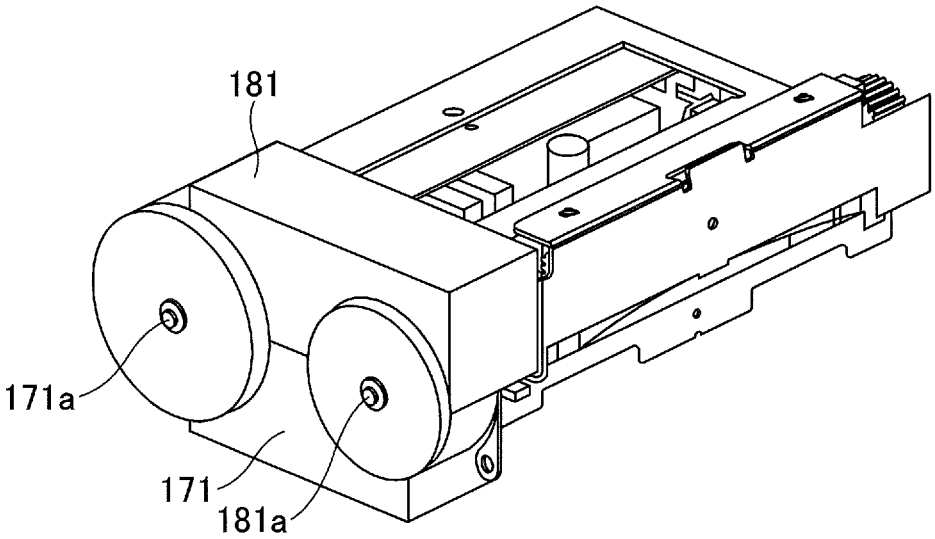
FIG. 20 is a perspective view of the printer according to a third modification.
Figure 21:
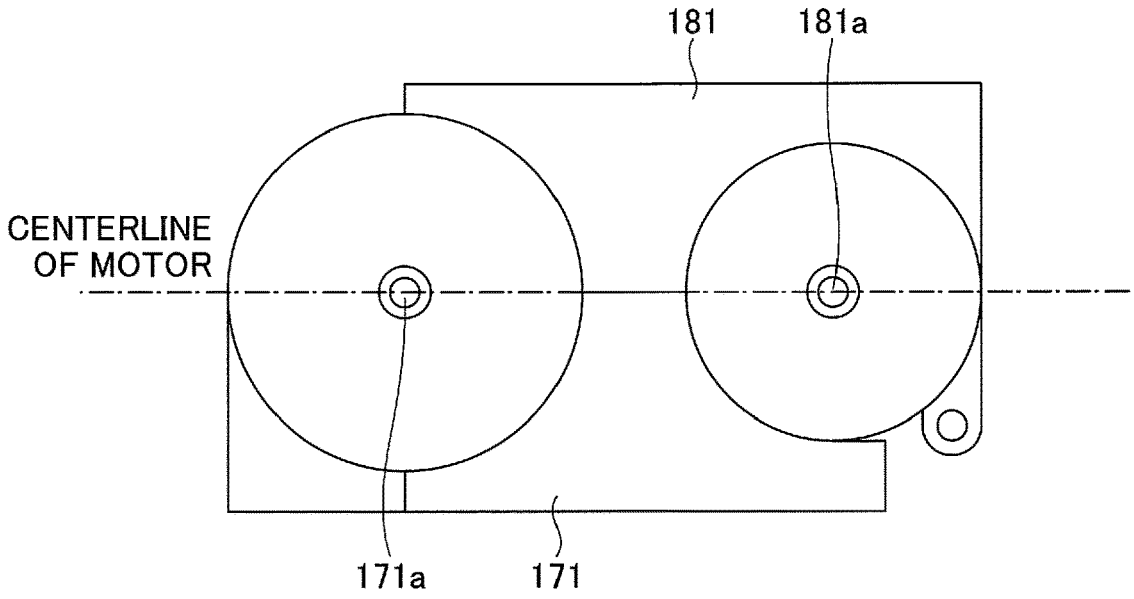
FIG. 21 is a diagram for explaining the printer according to the third modification.
Figure 22:
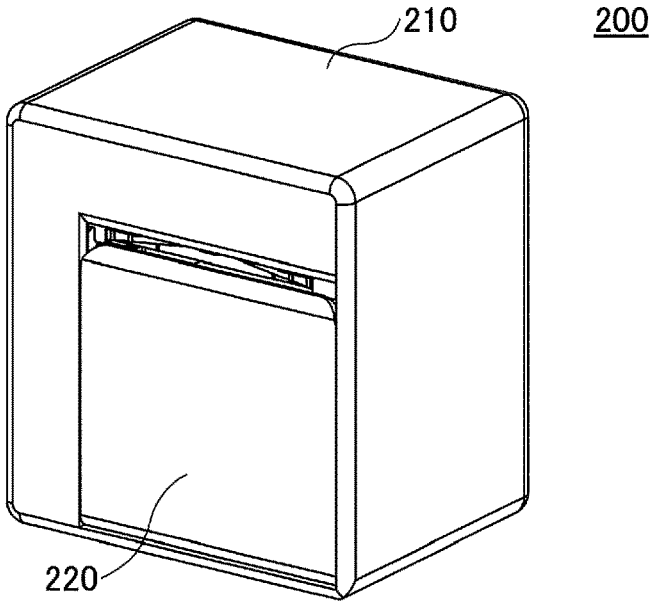
FIG. 22 is a diagram for explaining a first usage of the printer.
Figure 23:
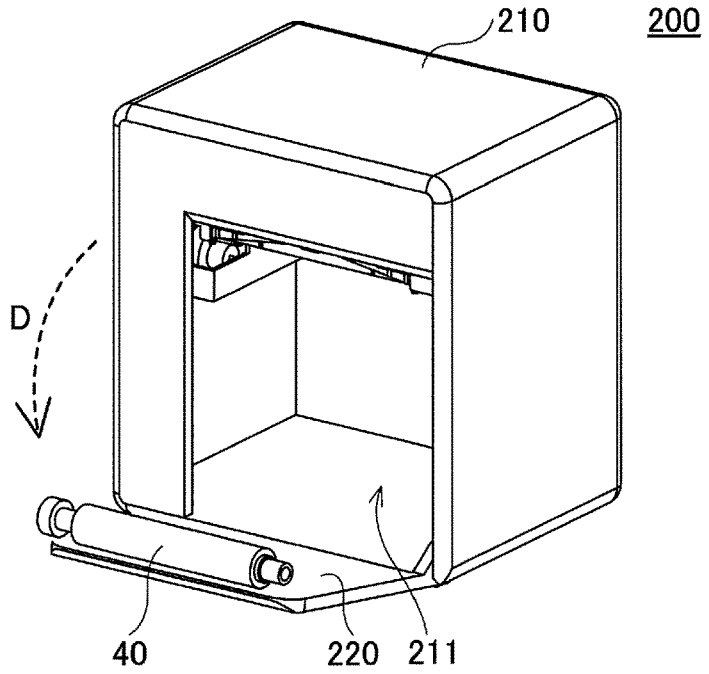
FIG. 23 is a diagram for explaining the first usage of the printer.
Figure 24:
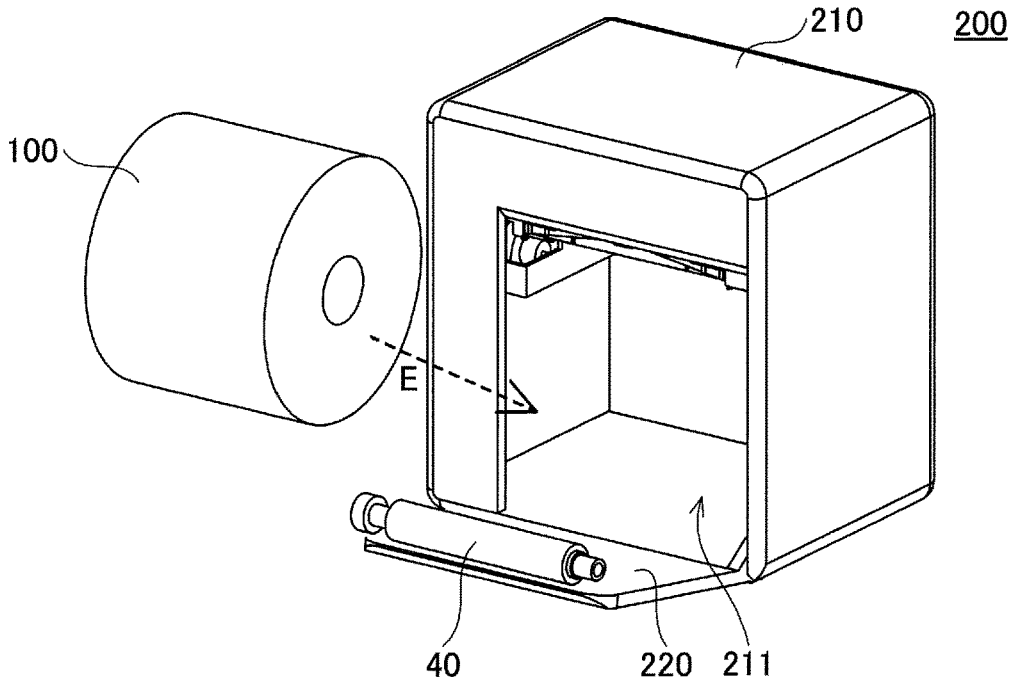
FIG. 24 is a diagram for explaining the first usage of the printer.
Figure 25:
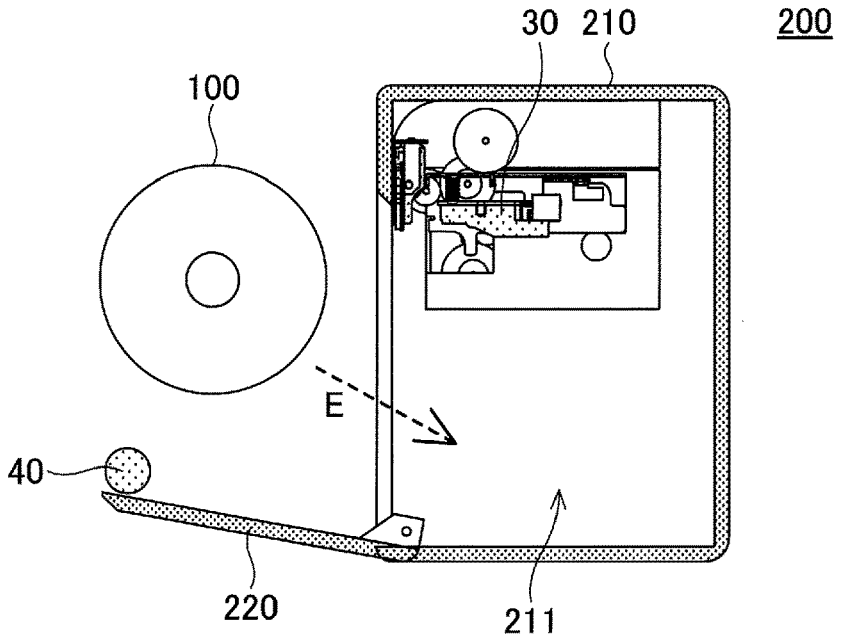
FIG. 25 is a diagram for explaining the first usage of the printer.

As illustrated in FIGS. 20 and 21, a center 171*a* of a motor of a driving module 171, and a center 181*a* of a motor of a driving module 181 may be arranged to lie on the same centerline. By this arrangement of the driving modules 171 and 181, it is possible to reduce the height of the printer compared to the example illustrated in FIG. 6, to enable size reduction of the printer.

As illustrated in FIGS. 9 through 11, the recording paper 100 can be inserted into the printer by opening the lid 120 on the side of the housing 110, and setting the recording paper 100 approximately parallel to the axial direction of the platen roller 40. However, the recording paper 100 can also be inserted into the printer in a direction perpendicular with respect to the axial direction of the platen roller 40 or perpendicular with respect to the longitudinal direction of the print head 30.

In the case of a printer unit 200 having a lid 220 provided at a front of a housing 210 as illustrated in FIGS. 22 through 25, the lid 220 is rotated in a direction D to open. In the printer unit 200, the platen roller 40 is mounted on the lid 220, and the head module, the cutter module, and the driving modules are mounted on the housing 210. The recording paper 100 is inserted in a direction E, between the print head 30 and the platen roller 40, into a holder 211. Thereafter, the recording paper 100 is pinched between the print head 30 and the platen roller 40 when the lid 220 is closed, so that the recording paper 100 becomes printable by the print head 30.

Figure 26:
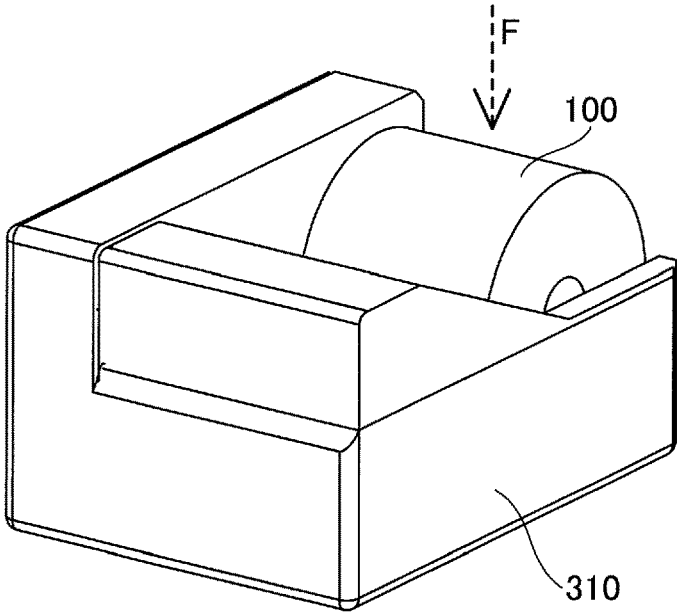
FIG. 26 is a diagram for explaining a second usage of the printer.
Figure 27:
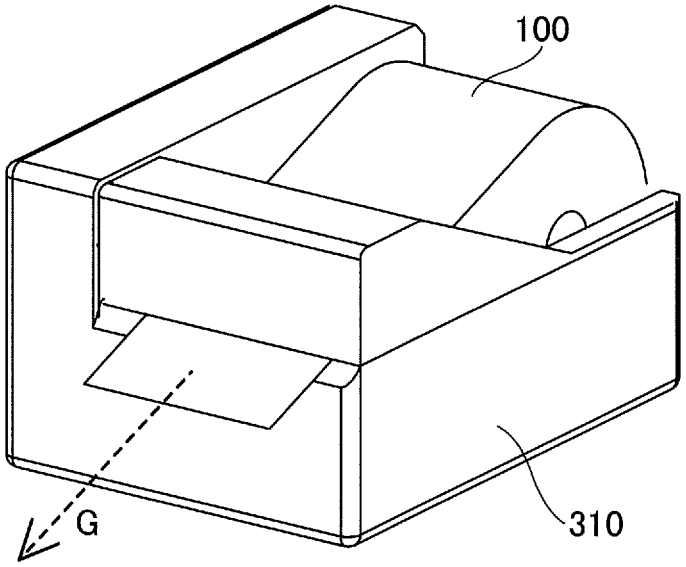
FIG. 27 is a diagram for explaining the second usage of the printer.
Figure 28:
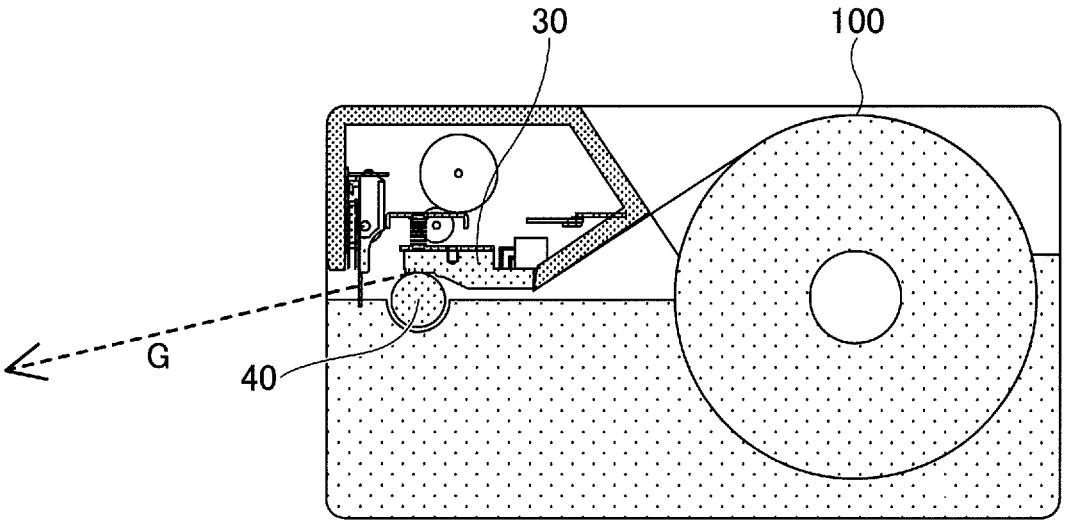
FIG. 28 is a diagram for explaining the second usage of the printer.

In the case of a printer unit not provided with a lid as illustrated in FIGS. 26 through 28, the recording paper 100 is inserted in a direction F, into a holder within a housing 310. When the recording paper 100 set in the holder is automatically transported between the print head 30 and the platen roller 40 as indicated by an arrow G, the recording paper 100 becomes printable by the print head 30. Accordingly, the recording paper 100 can also be set into the printer from a rear of the printer.

Figure 29:
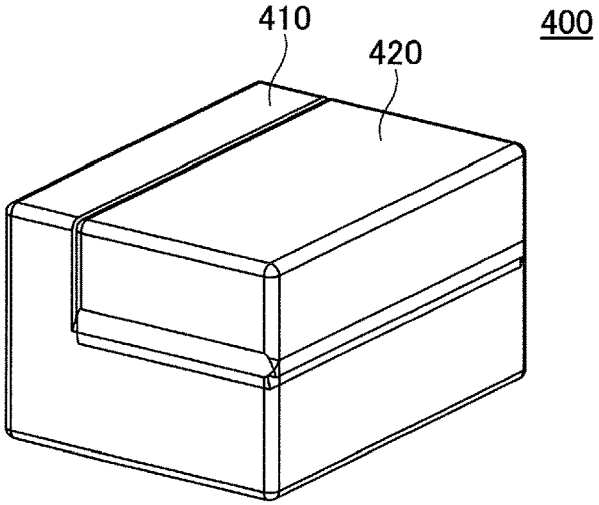
FIG. 29 is a diagram for explaining a third usage of the printer.
Figure 30:
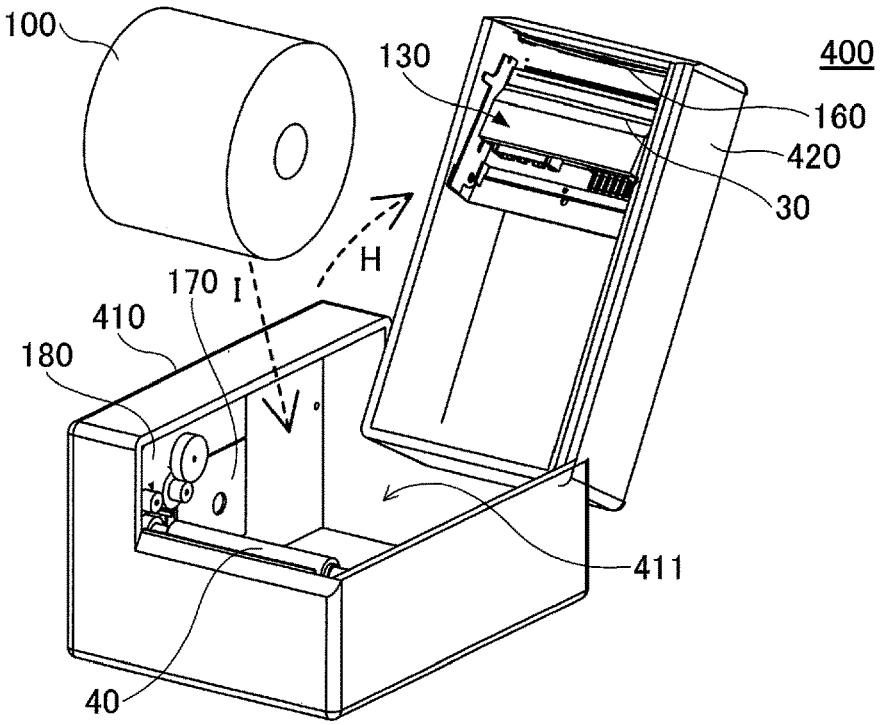
FIG. 30 is a diagram for explaining the third usage of the printer.

In the case of a printer unit 400 provided with a lid 420 on an upper part of a housing 410 as illustrated in FIGS. 29 and 30, the lid 420 is opened in a direction H. The head module 130 and the cutter module are mounted on the lid 420. The platen roller 40, and the driving modules 170 and 180 are mounted inside the housing 410. After the lid 420 is opened, the recording paper 100 is inserted in a direction I, between the print head 30 and the platen roller 40, into a holder 411. By closing the lid 420 thereafter, the recording paper 100 is pinched between the print head 30 and the platen roller 40, so that the recording paper 100 becomes printable by the print head 30.

Accordingly to the disclosed printer, it is possible to insert the recording paper into the printer from various directions.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A printer comprising:

a frame;

a print head configured to print on recording sheet;

a platen roller configured to transport the recording sheet in a state pinched between the print head and the platen roller;

a movable blade configured to cut the recording sheet;

a roller driving module, detachably and selectively attached to the frame, and configured to drive the platen roller, the roller driving module including a first casing, and a first motor and a first gear accommodated inside the first casing; and a cutter driving module, detachably and selectively attached to the frame, and configured to drive the movable blade, the cutter driving module including a second casing, and a second motor and a second gear accommodated inside the second casing, wherein the roller driving module and the cutter driving module are both provided at one end along an axial direction of the platen roller.

2. The printer as claimed in claim 1, further comprising:

a head module, detachably and selectively attached to the frame, and including the print head;

a cutter module, detachably and selectively attached to the frame, and including the movable blade; and a platen module, detachably and selectively attached to the frame, and including the platen roller, wherein each of the head module, the cutter module, the platen module, the roller driving module, and the cutter driving module is selectively and separately replaceable.

3. The printer as claimed in claim 1, wherein the roller driving module and the cutter driving module are arranged to vertically overlap each other.

4. The printer as claimed in claim 1, wherein the first motor and the second motor are respectively arranged at positions in front and rear with respect to a direction in which the recording sheet is transported.

5. The printer as claimed in claim 4, wherein a center of the first motor and a center of the second motor are arranged to lie on the same centerline.

6. An electronic apparatus comprising:

a housing;

a holder, provided on the housing, and configured to accommodate a roll of recording sheet; and a printer set inside the housing, wherein the printer includes a print head configured to print on the recording sheet, a platen roller, a movable blade configured to cut the recording sheet, a roller driving module configured to drive the platen roller, and a cutter driving module configured to drive the movable blade, wherein the roller driving module and the cutter driving module are both provided at a first end along an axial direction of the platen roller, and wherein the roll of the recording sheet is insertable into the holder from a second end, opposite to the first end, along the axial direction of the platen roller.

7. The electronic apparatus as claimed in claim 6, further comprising:

a lid provided on the second end of the printer.

8. The electronic apparatus as claimed in claim 6, wherein the roll of the recording sheet is insertable into the holder from one of a front and a top of the printer.

9. The electronic apparatus as claimed in claim 8, further comprising:

a lid provided on the one of the front and the top of the printer.

10. The electronic apparatus as claimed in claim 6, wherein the printer further includes a frame, wherein the roller driving module includes a first casing, and a first motor and a first gear accommodated inside the first casing, and is detachably and selectively attached to the frame, and wherein the cutter driving module includes a second casing, and a second motor and a second gear accommodated inside the second casing, and is detachably and selectively attached to the frame.

* * * * *